US007125183B2

(12) United States Patent
Kinjyou

(10) Patent No.: US 7,125,183 B2
(45) Date of Patent: Oct. 24, 2006

(54) RECORDING APPARATUS AND METHOD THEREOF AND REMOVING CLAW THEREFOR

(75) Inventor: Kazuaki Kinjyou, Shizuoka (JP)
(73) Assignee: Fuji Photo Film Co., Ltd., Kanagawa (JP)

( * ) Notice: Subject to any disclaimer, the term of this patent is extended or adjusted under 35 U.S.C. 154(b) by 555 days.

(21) Appl. No.: 09/758,203

(22) Filed: Jan. 12, 2001

(65) Prior Publication Data

US 2001/0052922 A1 Dec. 20, 2001

(30) Foreign Application Priority Data

Jan. 12, 2000 (JP) ..... 2000-003668
Jan. 10, 2001 (JP) ..... 2001-002655

(51) Int. Cl.
*B65H 29/54* (2006.01)

(52) U.S. Cl. ..... 400/644; 399/398; 399/399; 271/311; 271/900

(58) Field of Classification Search ..... 400/642, 400/644; 101/409; 399/398, 399, 323; 271/307, 271/308, 311, 312, 313, 900
See application file for complete search history.

(56) References Cited

U.S. PATENT DOCUMENTS 4,447,054 A * 5/1984 Sone ..... 271/311
4,487,158 A * 12/1984 Kayson ..... 118/245
5,160,130 A * 11/1992 Fromm et al. ..... 271/307
6,293,545 B1 * 9/2001 Hanks et al. ..... 271/311

* cited by examiner

*Primary Examiner*—Andrew H. Hirshfeld
*Assistant Examiner*—Kevin D. Williams
(74) *Attorney, Agent, or Firm*—Sughrue Mion, PLLC

(57) ABSTRACT

A removing claw 164 has a width W1 in a cross direction of 5 [mm] and a rectangular cross section with a height reduced toward a tip, and both ends of an upper side of the rectangle are chamfered to have a chamfered portion with a radius of r=1 [mm]. Consequently, a contact area of a toner sheet with the removing claw 164 is large. Therefore, a face pressure of a surface of the removing claw 164 where the toner sheet is to be delivered is reduced. Accordingly, the toner sheet can be delivered while being removed by the removing claw 164 without a material thereof rubbed and shaved by the surface of the removing claw and shaved by both ends of the upper side of the removing claw 164 even if the toner sheet comes in contact with the removing claw.

7 Claims, 7 Drawing Sheets

RECORDING APPARATUS AND METHOD THEREOF AND REMOVING CLAW THEREFOR

BACKGROUND OF THE INVENTION

1. Field of the Invention

The present invention relates to a recording apparatus and method for recording information such as images or characters on a recording medium and a removing claw to be used for the apparatus, and more particularly to a recording apparatus having a removing mechanism provided close to a rotary drum for recording, a recording method and a removing claw to be used for the apparatus.

2. Description of the Related Art

In a conventional recording apparatus, a laser beam is irradiated from an optical head onto a recording medium fixed to a rotary drum for recording (which will be hereinafter referred to as a "recording drum") or a recording plane, thereby recording images and characters. In this case, a toner sheet having a thermal melting, thermal adhesive or sublimate coloring material layer (photothermal conversion+toner layer) formed on a support such as a permeable PET (polyethylene terephthalate) base and an image receiving sheet having an image receiving layer for receiving a toner to be transferred are used for the recording medium, and the toner sheet is heated corresponding to image and character data and a heated portion of the toner layer is transferred onto the image receiving layer of the image receiving sheet. Thus, an image is recorded on the image receiving sheet.

A toner sheet having each of colors of K (black), C (cyan), M (magenta) and Y (yellow) or a toner sheet having each of colors of gold, silver, brown and gray can be used. For example, a full color image can be obtained by using a toner sheet having four colors of KCMY.

The toner sheet and the image receiving sheet which are to be used have different structures and characteristics depending on the uses respectively, and the details thereof have been described in JP-A-4-296594, JP-A-4-327982 and JP-A-4-327983 according to the application of the present applicant.

FIG. 3 is a diagrammatic sectional view showing a color image recording apparatus 30 according to a conventional example.

In FIG. 3, the color image recording apparatus 30 according to the conventional example serves to obtain a full color image by using a toner sheet having four colors of KCMY, and comprises a recording medium feeding section 32, a recording drum 34, a recording medium fixating/releasing mechanism 36, a laminate mechanism 38, an exposing head 40, a control section 48, a removing mechanism 42, a paper feeding section 44, a laminate section 46, a removing section 50 and a tray section 52.

In the color image recording apparatus 30 according to the conventional example, the recording medium fixing/releasing mechanism 36 fixes an image receiving sheet 10 fed from the recording medium feeding section 32 onto the recording drum 34, and the laminate mechanism 38 pressurizes, heats, presses and laminates a toner sheet 11 fed from the recording medium feeding section 32 onto the image receiving sheet 10. When the exposing head 40 heat mode exposes a laminated product of the image receiving sheet 10 and the toner sheet 11 to record an image as a latent image, the removing mechanism 42 removes the toner sheet 11 from the image receiving sheet 10 fixed onto the recording drum 34, and transfers and develops the image of the toner sheet 11 recorded as a latent image onto the image receiving sheet 10. Consequently, an image is formed on the image receiving sheet 10.

For example, thus, the image receiving sheet 10 in which images having four colors of K, C, M and Y are accurately registered and the removing, transferring and developing operations are carried out is removed from the recording drum 34 through the removing mechanism 42, and is laminated and closely bonded to a paper 14 in the laminate section 46. Then, the image receiving sheet 10 is removed from the paper 14 in the removing section 50. Consequently, a full color image can be obtained as a hard copy.

On the other hand, there is also a high speed one path printer capable of forming a color image through a one-time processing in addition to the recording method of repeating exposure and development for four colors. More specifically, recording is carried out, by means of a light source having a plurality of wavelengths, on a monosheet sensitive material to be independently sensitized with a plurality of wavelengths respectively, and development is then performed through a heat source. With such a structure, four-color exposure is carried out on a sensitive material having a four-color and four-layer structure through one-time exposure by means of an exposure head capable of performing laser irradiation having corresponding four wavelengths. Therefore, a high speed processing can be achieved.

FIG. 3 is a view showing a structure of the monosheet sensitive material printer, (a) being a perspective view and (b) illustrating a principle. As shown in FIG. 3(*a*), a sheet obtained by cutting, into a print size one by one, a plural-wavelength photosensitive material having a photothermal developing layer shown in FIG. 3(*b*) is used as a recording medium 3 and is wound and fixed onto a rotary drum 22 for recording. The rotary drum 22 for recording is rotated in a direction of an arrow and two-dimensionally scans and exposes a transfer material 3 on the recording medium 3 through a four-colored laser beam of an image while moving through a moving stage 24 from an optical head 21 capable of carrying out laser beam irradiation having four wavelengths shown in FIG. 3(*b*) in a direction orthogonal to the direction of rotation of the rotary drum 22 for recording. If the recording medium 3 which has been exposed like an image is thermally developed, an unexposed portion is colored so that a color print of the monosheet is obtained by the high speed one path method.

Next, an operation will be described. An example of the recording medium to be used is shown in FIG. 3(*b*). A sensitive material for reacting to a light provided with layers having different wavelengths to generate colors of (Y, M, C and K) is superposed in multilayers on a transparent support such as a light transmission PET through an intermediate layer respectively, and the recording medium is fixed onto the rotary drum 22 for recording.

The optical head 21 to be used can simultaneously irradiate a light having a plurality of (four-colored) laser wavelengths such as Y: 410 nm (LD) or 405 nm (SHG), M: 532 nm or 526 nm (SHG), C: 680 nm or 660 nm (LD) and K: 830 nm or 780 nm (LD) which correspond to four colors of Y, M, C and K. The LD represents a laser diode, and the SHG represents a Second Harmonics Generator (secondary harmonics generator) and serves to obtain a light having a wavelength ranging from 1064 nm to 532 nm, for example.

The laser head is constituted as shown in FIG. 3(*b*) to irradiate a laser beam having four wavelengths from a total reflecting prism AP to the recording medium 3 through each dichroic prism. A dichroic mirror can freely select a transmission wavelength and a reflection wavelength depending on a method of depositing an interference film. A dichroic mirror for LD1 reflects a light having a wavelength of 830 nm and transmits others and a dichroic mirror for LD2 reflects a light having a wavelength of 630 nm and transmits a light having a wavelength of 830 nm.

The laser beam having four wavelengths transmitted from the total wavelength reflecting prism shown in FIG. 3(*b*) is moved through the moving stage 24, thereby scanning and exposing the recording medium 3 of the rotary drum 22 for recording through the laser beam having four wavelengths. A latent image is independently recorded for each color with a laser beam having a wavelength (a wavelength ranging from 300 nm to 1100 nm) corresponding to an absorption wavelength of a photothermal developing layer for each color. For example, laser recording is carried out in the vicinity of a wavelength of approximately 830 nm based on K data, in the vicinity of a wavelength of approximately 650 nm based on C data, in the vicinity of a wavelength of approximately 530 nm based on M data and in the vicinity of a wavelength of approximately 400 nm based on Y data. By thus exposing the four colors of K, C, M and Y through the laser beam at the same time, it is possible to shorten a time required for recording to a quarter of that in the recording method shown in FIG. 2.

A latent image is formed in only a portion where the laser beam is irradiated. Therefore, when heat is applied through a heating roller which is not shown, for example, at a next coloring step, the same portion is thermally developed.

The monosheet-shaped recording medium 3 which has been thus exposed with the four colors is accurately removed from the rotary drum 22 for recording through a removing mechanism according to the invention after the exposure and is delivered to a discharge tray.

FIG. 4 shows the specific structure and removing operation of the removing mechanism 42. FIG. 4 is a sectional view showing the removing mechanism 42 in the color image recording apparatus of FIG. 3, and FIGS. 4(*a*) to 4(*e*) show the removing operation.

In FIG. 4, the removing mechanism 42 includes a removing roller 62, a removing unit 63 constituted by a removing claw 64 and a metal plate guide 65, moving means 66 and a delivery roller 71.

The removing roller 62 is constituted to come in contact with or remove from the recording drum 34. When the toner sheet 11 or the image receiving sheet 10 is to be removed from the recording drum 34, the removing roller 62 comes in contact with the recording drum 34. Then, the removing roller 62 is rotated in a direction opposite to a direction of rotation of the recording drum 34 (a direction of an arrow shown in a dotted line), and presses the laminated product of the image receiving sheet 10 and the toner sheet 11 from the toner sheet 11 side.

Moreover, the removing unit 63 includes the removing claw 64 and the metal plate guide 65. More specifically, when the removing unit 63 is to remove the toner sheet 11 or the image receiving sheet 10 from the recording drum 34, it comes in contact with the recording drum 34 and delivers the toner sheet 11 or image receiving sheet 10 removed from the recording drum 34 to the delivery roller 71 along the removing claw 64 and the metal plate guide 65 with the rotation of the recording drum 34 while removing a tip of the toner sheet 11 or image receiving sheet 10 through the removing claw 64.

The specific structure of the removing unit 63 is shown in FIG. 5.

FIG. 5 is a view showing the structure of the removing unit 63 in the removing mechanism 42 of FIG. 3, FIG. 5(*a*) being a simplified sectional view showing the removing unit 63 and FIG. 5(*b*) being a front view showing the removing unit 63.

In FIG. 5(*a*), the removing unit 63 includes the removing claw 64 for removing the tip of the toner sheet 11 or image receiving sheet 10 from the recording drum 34, and the metal plate guide 65 fixed to the removing claw 64 through a fixing point 65*a*.

The removing claw 64 not only removes the toner sheet 11 or image receiving sheet 10 at the tip thereof but also functions as a delivery guide. When the tip of the toner sheet 11 or image receiving sheet 10 is removed, the removing claw 64 then delivers the toner sheet 11 or the image receiving sheet 10 to the delivery roller 71 together with the metal plate guide 65 while removing the toner sheet 11 or the image receiving sheet 10. The metal plate guide 65 has such a structure as to be extended in a vertical direction with respect to the direction of the rotation of the recording drum 34 as shown in FIG. 5(*b*), and is provided with a plurality of removing claws 64 at almost regular intervals in a longitudinal direction thereof. The metal plate guide 65 delivers the toner sheet 11 or image receiving sheet 10 removed through the removing claw 64.

When the toner sheet 11 or the image receiving sheet 10 is to be removed from the recording drum 34, the moving means 66 moves the removing unit 63 such that the removing claw 64 comes in contact with the recording drum 34. Moreover, while the delivery roller 71 is rotated in a direction opposite to the direction of the rotation of the recording drum 34 (see FIG. 4(*e*)), it interposes and delivers the toner sheet 11 or the image receiving sheet 10 from the metal plate guide 65 to the laminate section 46.

Moreover, the recording drum 34 has sucking trenches 22*a* and 22*b* for adsorbing and fixing the image receiving sheet 10 and the toner sheet 11 provided on a surface thereof. More specifically, inside air is sucked by means of sucking sources such as an outside air blower and a vacuum pump of a vacuum sucking mechanism which is not shown so that the recording drum 34 sucks, through the sucking trenches 22*a* and 22*b*, the image receiving sheet 10 and the toner sheet 11 which are delivered to the surface and holds and fixes them on the surface. FIG. 6 is a partially expanded sectional view showing the recording drum 34.

In FIG. 6, an outermost rectangle is obtained by cutting and expanding the recording drum 34 in an axial direction. Moreover, an inside rectangle indicates the toner sheet 11 to be fed and adsorbed onto the image receiving sheet 10 and a further inside rectangle indicates the image receiving sheet 10 to be adsorbed onto the recording drum 34.

The recording drum 34 is provided with the sucking trenches 22*a* and 22*b* for firmly fixing a tip portion of each of the image receiving sheet 10 and the toner sheet 11 which are opened within a range in which the image receiving sheet 10 and the toner sheet 11 on the surface are secured. In general, the toner sheet 11 is larger than the image receiving sheet 10, the image receiving sheet 10 is adsorbed by the sucking trench 22*a* and the toner sheet 11 is adsorbed by the sucking trench 22*b* positioned in a larger portion than the image receiving sheet 10. Accordingly, it is possible to prevent the image receiving sheet 10 and the toner sheet 11 from being taken off from the recording drum 34.

Moreover, the removing mechanism 42 can remove the toner sheet 11 or the image receiving sheet 10 by utilizing the sucking trenches 22*a* and 22*b* for adsorbing and fixing the image receiving sheet 10 and the toner sheet 11 which are provided on the recording drum 34.

The removing operation of the removing mechanism 42 will be described below in detail with reference to FIG. 4. Since the operation for removing the toner sheet 11 and the image receiving sheet 10 is carried out in the same manner, description will be given to only the removing operation to be carried out for removing the toner sheet 11 from the recording drum 34.

FIG. 4(*a*): In the case in which the toner sheet 11 is to be removed from the image receiving sheet 10 in the removing mechanism 42, the removing roller 62 first comes in contact with the recording drum 34 which is being rotated in a direction of an arrow shown in a dotted line and presses the laminated product of the image receiving sheet 10 and the toner sheet 11 while being rotated in a direction opposite to the direction of the rotation of the recording drum 34 from the toner sheet 11 side (in a direction of an arrow shown in a solid line). Then, the moving means 66 moves the removing unit 63 in a direction of an arrow shown in a solid line such that the removing claw 64 comes in contact with the recording drum 34 which is being rotated.

FIG. 4(*b*): When the removing claw 64 comes to a position of the sucking trench 22*b* for the toner sheet 11 by the rotation of the recording drum 34, the moving means 66 moves the removing unit 62 to cause the removing claw 64 to enter the sucking trench 22*b* for the toner sheet 11.

FIG. 4(*c*): The removing claw 64 removes the tip of the toner sheet 11 with the rotation of the recording drum 34. Then, when the tip of the toner sheet 11 is lifted by the removing claw 64, the toner sheet 11 is delivered along the metal plate guide 65 while being removed. In this case, the removing claw 64 also delivers the toner sheet 11 together with the metal plate guide 65 as a delivery guide. Consequently, thermal energy is applied to an image through heat mode exposure so that the bonding force of the toner layer is reduced. Thus, the laminated product of the toner sheet 11 having an image formed as a latent image and the image receiving sheet 10 having the image receiving layer to which the toner sheet 11 is bonded is removed and the image of the toner sheet 11 which is recorded as the latent image is transferred and developed onto the image receiving sheet 10.

FIG. 4(*d*): When the toner sheet 11 is started to be delivered while being removed, the moving means 66 moves the removing unit 63 to be kept away from the recording drum 34 (in a direction of an arrow shown in a solid line) so that the image receiving sheet 10 can be prevented from being removed through the removing claw 64. Consequently, only the toner sheet 11 can be removed and delivered.

FIG. 4(*e*): When the tip of the toner sheet 11 is interposed between the delivery rollers 71, the delivery rollers 71 interpose and deliver the toner sheet 11 to the laminate section 46 while being rotated in a direction of an arrow shown in a solid line and holding the tip of the toner sheet 11 delivered along the metal plate guide 65.

By repeating the removing steps 4(*a*) to 4(*e*) for the toner sheet 11 having predetermined colors, for example, four colors of KCMY, a full color image is formed on the image receiving sheet 10.

FIG. 7 is a view showing the structure of the removing claw 64 according to the conventional example. FIG. 7(*a*) is a side view showing the removing claw, FIG. 7(*b*) is a top view, and FIG. 7(*c*) is a sectional view showing the removing claw 64 of FIG. 7(*a*) which is taken along a line 7–7'.

As shown in FIG. 7, the conventional removing claw 64 includes a claw body 64*a* having a rectangular cross section with a height reduced toward a tip, and a base 64*b*, and serves to remove, at a tip thereof, a tip of the toner sheet 11 or image receiving sheet 10 and to deliver the toner sheet 11 or image receiving sheet 10 thus removed along a slant face. A width W in a cross direction of the claw body 64*a* is 3 [mm]. Moreover, the base 64*b* has a width which is reduced toward a tip and is equal to the width of the claw body 64*a* at the tip thereof.

Pressure at a surface of the removing claw given from the sensitive material is about 2 Kpa in accordance with the weight of the recording media and the number of the removing claws.

In the removing mechanism 42 of the color image recording apparatus 30 according to the conventional example, when the toner sheet 11 having the tip removed through the removing claw 64 is to be delivered to the delivery roller 71, the toner sheet 11 comes in contact with the removing claw 64. However, the removing claw 64 has a small face to come in contact with the toner sheet 11 and has both ends of an upper side provided at a right angle. Therefore, a material of the toner sheet 11 is rubbed and shaved by the surface of the removing claw 64 and the corners of both ends of the upper side. In particular, if a face pressure of the toner sheet and the removing claw (a pressure of the contact face) is high, more shavings are generated.

The shavings of the material stick onto the recording drum 34 and the image receiving sheet 10. As a result, there is a problem in that image defects (image unevenness, a void and a white ring) are generated on a finished image.

In order to solve such a problem, the present inventor has presented, as a prior invention, a printer mechanism in which a delivery speed of the delivery roller 71 is set to be higher than that of the recording drum 34 for the toner sheet 11 to eliminate the deflection of the toner sheet 11 between the recording drum 34 and the delivery roller 71 and the removing claw 64 is moved to the outside of a delivery path for the toner sheet 11 to prevent the contact of the removing claw 64 with the toner sheet.

However, the toner sheet 11 comes in contact with the removing claw 64 before it is removed and interposed between the delivery rollers 71. Consequently, there is a problem in that image defects are generated at a ratio of one to several tens.

SUMMARY OF THE INVENTION

In order to solve the problem, the present invention has an object to provide a recording apparatus and method capable of preventing the shavings of a material from being generated when removing the material after recording, and a removing claw to be used for the apparatus.

In order to achieve the object, a first aspect of the invention is directed to a recording apparatus comprising a medium fixing member for fixing, onto a surface, a recording medium including a toner sheet having a toner layer and an image receiving sheet having an image receiving layer and serving to receive the toner layer transferred from the toner sheet, and removing means for removing the toner sheet or the image receiving sheet from the medium fixing member, wherein the removing means has a removing claw, the removing claw having a rectangular cross section with a height reduced toward a tip and both ends of an upper side of the rectangle being rounded or chambered.

Furthermore, a second aspect of the invention is directed to the recording apparatus, wherein the removing claw has the rounded or chamfered portion with a radius of curvature of r=1 [mm] or more and an upper face of the tip with a face pressure of 10 [KPa] or less.

Furthermore, a third aspect of the invention is directed to the recording apparatus according to the first, second, third or fourth aspect, wherein the toner sheet is of a thin film transfer type.

Moreover, a fourth aspect of the invention is directed to a removing claw for removing a toner sheet or an image receiving sheet from a medium fixing member, wherein a cross section has a rectangle with a height reduced toward a tip and both ends of an upper side of the rectangle are rounded or chamfered.

Moreover, a fifth aspect of the invention is directed to the removing claw according to the sixth aspect, wherein the rounded or chamfered portion has a radius of curvature of r=1 [mm] or more and an upper face of the tip has a face pressure of 1 [KPa] or less.

Moreover, a sixth aspect of the invention is directed to the removing claw according to the fourth or fifth aspect, wherein the toner sheet is of a thin film transfer type.

Furthermore, a seventh aspect of the invention is directed to a recording method in the recording apparatus according to the first to fifth aspects, comprising the steps of fixing the image receiving sheet onto the medium fixing member, fixing the toner sheet onto the image receiving sheet, and removing the toner sheet or the image receiving sheet from the medium fixing member.

In the recording apparatus and method and the removing claw to be used for the apparatus according to the first, second, fourth, fifth and seventh aspects of the invention, the removing means for removing the toner sheet or image receiving sheet fixed to the medium fixing member has the removing claw in which the cross section has a rectangle with a height reduced toward a tip and both ends of an upper side of the rectangle are rounded or chamfered with a radius of curvature. Moreover, the removing claw has such a shape that a face pressure is 10 [KPa] or less and a radius of curvature of the rounded or chamfered portion is r=1 [mm] or less. Consequently, when the toner sheet is to be removed and delivered in the removing means, the material thereof is neither rubbed nor shaved by the surface of the removing claw and is not shaved by both ends of the upper side of the removing claw even if the toner sheet comes in contact with the removing claw. As a result, a great image can be obtained without generating an image defect on a finished image.

DESCRIPTION OF THE PREFERRED EMBODIMENTS

Figure 1A:
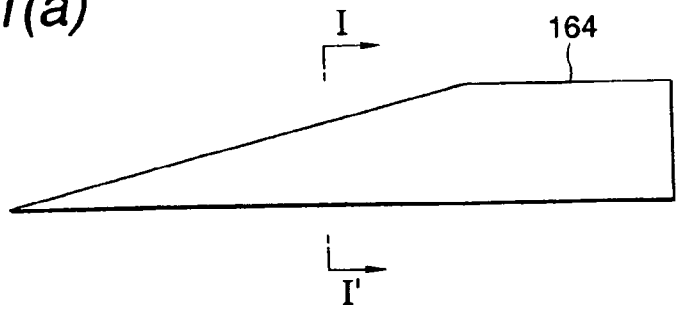
FIGS. 1(A)–1(C) are to show a view showing a structure of a removing claw according to a first embodiment of the invention.

A recording apparatus according to the invention will be described below in detail in order of a "first embodiment" and a "second embodiment" with reference to the drawings.

Before detailed description of embodiments, a recording apparatus according to the embodiments will be first described. Since the functions and operations of components other than a removing claw in the recording apparatus according to the embodiments are the same as those in the conventional example, the recording apparatus according to the embodiments will be described with reference to FIG. 3.

A color image recording apparatus 30 according to the embodiment comprises a recording medium feeding section 32, a recording drum 34, a recording medium fixing/releasing mechanism 36, a laminate mechanism 38, an exposing head 40, a removing mechanism 42, a control section 48, a paper feeding section 44, a laminate section 46, a removing section 50 and a tray section 52.

The recording medium feeding section 32 has a recording medium station 53 holding a recording medium (more specifically, a roll-shaped image receiving sheet 10 and a plurality of toner sheets 11, for example, a roll-shaped thermal sensitive material such as a standard toner sheet having colors of K (black), C (cyan), M (magenta) and Y (yellow) and a characteristic sheet having colors of gold and silver to be used for a printing field), a pair of drawing rollers 54 for drawing one recording medium, a cutter 55 for cutting, in the form of a sheet, the recording medium drawn by a predetermined length from the recording medium station 53 through the drawing roller 54, a pair of rollers 56 for interposing and delivering the sheet-shaped recording medium, and a guide 57 for guiding the sheet-shaped recording medium onto the recording drum 34 and guiding a tip of the recording medium to a fixing position of the recording medium fixing/releasing mechanism 36 attached onto the recording drum 34.

Moreover, the recording drum 34 corresponds to a medium fixing member for fixing, onto a surface, a recording medium including the toner sheet 11 having a toner layer and the image receiving sheet 10 having an image receiving layer and serving to receive the toner layer transferred from the toner sheet 11. More specifically, the recording drum 34 has a sucking hole (not shown) and sucking trenches 22*a* and 22*b* provided on a surface thereof, and serves to hold and fix, on the surface thereof, the recording medium delivered from the recording medium feeding section 32 by suction of inside air through a vacuum sucking mechanism (not shown).

Furthermore, the recording medium fixing/releasing mechanism 36 fixes a tip of the image receiving sheet 10 fed onto the recording drum 34 through a clamp. Moreover, when the image receiving sheet 10 is wound onto the outer periphery of the recording drum 34 by rotation of the recording drum 34 in a direction of an arrow in the drawing, a rear end of the image receiving sheet 10 is also fixed. Preferably, at least one of the fixed tip portion of the recording medium fixing/releasing means 36 and the fixed rear end portion thereof can be moved over the outer periphery of the recording drum 34 such that recording medium sheets having various lengths can be fixed onto the recording drum 34.

Moreover, the laminate mechanism 38 has a laminate roller 58 having a heater (not shown) provided therein, an arm 59 for rotating the laminate roller 58 around a fulcrum 59*a* and causing the laminate roller 58 to come in contact with or remove from the outer periphery of the recording drum 34, and press means 60 for pressing the laminate roller 58 onto the outer periphery of the recording drum 34 by predetermined press force, and serves to press, laminate and wind the toner sheet 11 delivered from the recording medium feeding section 32 onto the image receiving sheet 10 wound onto the outer periphery of the recording drum 34 in just the same manner.

Since an image receiving layer to be the outermost layer of the image receiving sheet 10 has adherence, the toner sheet 11 can be wound and laminated while being pressed by the predetermined press force through the laminate roller 58. Consequently, the toner sheet 11 is not wrinkled, and furthermore, the image receiving layer of the image receiving sheet 10 can be bonded to the toner layer of the toner sheet 11 by uniform bonding force.

The toner sheet 11 is laminated on the image receiving sheet 10 through the pressurizing laminate roller 58 in order to obtain uniform high adhesion. It is also preferable that the laminate roller 58 should be pressurized and heated to carry out lamination in order to enhance the bonding force. Preferably, the heating condition is 130° C. or less, more preferably, 100° C. or less. Moreover, the press means 60 may be energizing means such as a spring or a manipulator of an air cylinder.

When the image receiving sheet 10 is to be wound onto the recording drum 34, it is preferable that a tip of the image receiving sheet 10 should be fixed by the recording medium fixing/releasing mechanism 36 and other portions thereof should be held by the delivery roller pair 56, the laminate roller 58 or other means and be wound onto the outer periphery of the recording drum 34 by application of a predetermined tension to the image receiving sheet 10. At this time, a sucking hole may be provided on the outer periphery of the recording drum 34 to adsorb the image receiving sheet 10 through adsorbing means as will be described below. Preferably, the adsorbing means and the recording medium fixing/releasing mechanism 36 are used together or only one of them may be used. Consequently, the image receiving sheet 10 can be fixed to the outer periphery of the recording drum 34 without generation of a wrinkle and a positional shift. Furthermore, it is preferable that a tension should be applied to the toner sheet 11 during the lamination of the toner sheet 11 on the image receiving sheet 10. At this time, the tip and/or the rear end of the toner sheet 11 may be fixed by using the recording medium fixing/releasing mechanism 36 in the same manner as the winding of the image receiving sheet 10 or the adsorbing means may be used together. It is preferable that the tension to be applied to the toner sheet 11 during the lamination should be smaller than the tension to be applied to the image receiving sheet 10 during the winding onto the recording drum 34.

The exposing head 40 includes modulating means, and has a laser head 24 constituted by a laser beam source for emitting high density energy rays such as a laser beam and an image forming lens for adjusting a beam spot diameter of the laser beam, and feeding means 61 for moving the laser head 24 in an axial direction of the recording drum 34 (a direction perpendicular to the paper of FIG. 3) to carry out feeding.

The toner sheet 11 is scanned through the laser beam by rotation of the recording drum 34. The feeding moving means 61 is not provided on the exposing head 40 but moving means may be provided in the axial direction of the recording drum 34 to move and feed the recording drum 34 in the axial direction while scanning the rotation thereof.

It is sufficient that the laser beam source can emit high density energy rays capable of carrying out heat mode exposure. For example, it is possible to use, for the laser beam source, a gas laser such as an argon ion laser, a helium neon laser or a helium cadmium laser, a solid-state laser such as a YAG laser, a semiconductor laser, and furthermore, a dye laser and an excimer laser. The laser beam is modulated through an image signal by a well-known method, for example, an argon ion laser beam is transmitted to an external modulator or a current to be injected into the semiconductor laser is controlled by a signal (direct modulation). A size of a laser spot collected on a photothermal converting layer and a scanning speed are set corresponding to a resolution required for an image and a recording sensitivity of a material. In the case of printing uses, a high resolution is generally required and it is preferable that a beam spot should be small in respect of a picture quality. However, a focal depth is reduced so that it is hard to carry out mechanical control. Moreover, if the scanning speed is too low, a heat loss of heat conduction to a toner sheet support is increased so that an energy efficiency is reduced and a time required for recording is prolonged, which is not preferable. Referring to recording conditions in the invention, a beam diameter on a photothermal converting layer is set to 5 to 50 μm, more preferably, 6 to 30 μm, and a scanning speed is set to 1 m/sec or more, preferably 3 m/sec or more.

An image signal is transmitted as a digital signal from an image reader, an image processor, a work station (W/S) having a DTP function, an electronic publishing system or various storage media (magnetic tape, floppy disk, hard disk, RAM card) provided on the outside of the recording apparatus 30 according to the invention to the control section 48 through an interface, and is subjected to a necessary processing and is then transmitted to the exposing head 40. Thus, the heat mode exposure of the laser head 24 is controlled.

Moreover, the control section 48 serves to carry out control of each portion of the recording apparatus 30 according to the invention and control of a whole sequence including control to feed the exposing head 40 through the feeding means 61 and to scan the rotation of the recording drum 34.

Furthermore, the removing mechanism 42 corresponds to removing means for removing the toner sheet 11 or the image receiving sheet 10 from the recording drum 34. More specifically, the toner sheet 11 having an image formed as a latent image through the heat mode exposure carried out by the exposing head 40 is removed from the image receiving sheet 10 and the latent image of the toner sheet 11 is simultaneously removed and is transferred and developed onto the image receiving sheet 10.

The removing mechanism 42 includes a removing roller 62, a removing unit 63, moving means 66 and a delivery roller pair 71. The removing roller 62 is pivotally supported on an arm 67 and is rotated around a fulcrum 67*a* such that it can come in contact with or remove from the recording drum 34. Moreover, there is provided press means 68 for causing the removing roller 62 to press a laminated product of the image receiving sheet 10 and the toner sheet 11 on the recording drum 34 through the arm 67. Furthermore, the removing unit 63 includes a removing claw and a metal plate guide (not shown) having a plurality of removing claws and can come in contact with the recording drum 34 through the moving means 66.

The thermal energy is applied to the image through the heat mode exposure and the bonding force of the toner layer is reduced so that an image is formed as a latent image. Consequently, the arm 67 is rotated around the fulcrum 67*a* to cause the removing roller 62 to approach the laminated product of the toner sheet 11 and the image receiving sheet 10 having the image receiving layer to which the toner sheet 11 is bonded, thereby pressing the laminated product from the toner sheet 11 side through the removing roller 62 and causing the removing unit 63 to approach the laminated product through the moving means 66 to insert the removing claw into the sucking trench 22*b*.

Then, the removing roller 62 is rotated in a direction opposite to the direction of the rotation of the recording drum 34 to interpose the toner sheet 11 removed through the removing claw between the delivery rollers 71 while moving (delivering) the toner sheet 11 along the removing claw and the metal plate guide with the rotation of the recording drum 34. Thus, while the toner sheet 11 is pressed by the removing roller 62, it is interposed between the delivery rollers 71 and is delivered and removed from the image receiving sheet 10.

A portion of the toner sheet 11 which is pressed by the removing roller 62 can be removed at a constant removing speed. Therefore, removing force can be constant. Thus, a vibration phenomenon such as stick-slip is not caused and removing unevenness is not generated. During the separation, the removing force to be applied to the image receiving sheet 10 is not changed. Therefore, a fixing position of the image receiving sheet 10 over the recording drum 34 is not shifted. Accordingly, registration precision is not reduced. Thus, it is possible to obtain a single-colored dot image having a high picture quality, a high resolution and a high gradation which does not generate removing unevenness and registration shift.

Thus, the image receiving sheet 10 in which images having four colors of K, C, M and Y are accurately registered and separation, transfer and development are carried out is guided to the guide member 70 by the delivery roller pair 71 and is then delivered to the laminate section 46.

Moreover, the laminate section 46 sets a timing corresponding to the delivery of the image receiving sheet 10 and the paper feeding roll 72 sends the paper 14 from a paper cassette 73 and guides and delivers the paper 14 through the guide member 70 in a left direction of the drawing. Then, the image receiving sheet 10 and the paper 14 are aligned and laminated through a resist roller pair 75. The paper 14 may be fed from a manual feeding port 44*a* to the paper feeding roll 72.

In some cases, moreover, the laminate section may be provided remotely from the recording apparatus.

The removing section 50 removes the image receiving layer which is easily hardened and removed from the image receiving sheet 10 through a removing roller pair 78 and a removing guide 79. Consequently, the image receiving layer is stuck onto the paper 14 and an image is transferred thereto. The paper 14 having the image transferred thereto is discharged as a hard copy to a proof tray 52*a* of the tray section 52 and the image receiving sheet 10 from which the image receiving layer has been removed is discarded into a discard tray 52*b*.

With such a structure, in the color image recording apparatus 30 according to the embodiment, the image receiving sheet 10 fed from the recording medium feeding section 32 is fixed onto the recording drum 34 and the toner sheet 11 fed from the recording medium feeding section 32 onto the image receiving sheet 10 is then pressurized, heated, pressed and laminated. When the laminated product of the image receiving sheet 10 and the toner sheet 11 is heat mode exposed through the exposing head 40 to record an image as a latent image, the toner sheet 11 is removed from the image receiving sheet 10 fixed onto the recording drum 34 through the removing mechanism 42 and the image of the toner sheet 11 which is recorded as a latent image is transferred and developed onto the image receiving sheet 10. Thus, an image is formed on the image receiving sheet 10.

Thus, the image receiving sheet 10 in which four-colored images of K, C, M and Y are accurately registered and separation, transfer and development are carried out, for example, is removed from the recording drum 34 through the removing mechanism 42. Then, the image receiving sheet 10 is laminated and closely bonded to the paper 14 and is thereafter removed from the paper 14 in the removing section 50. Consequently, it is possible to obtain a full color image as a hard copy.

[First Embodiment]

Figure 1B:
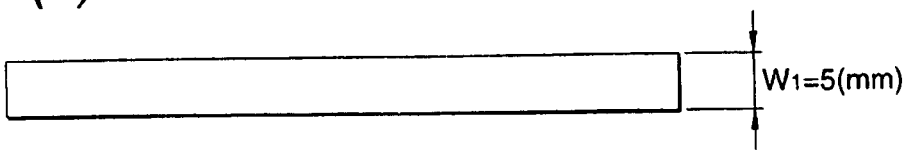
Figure 1C:
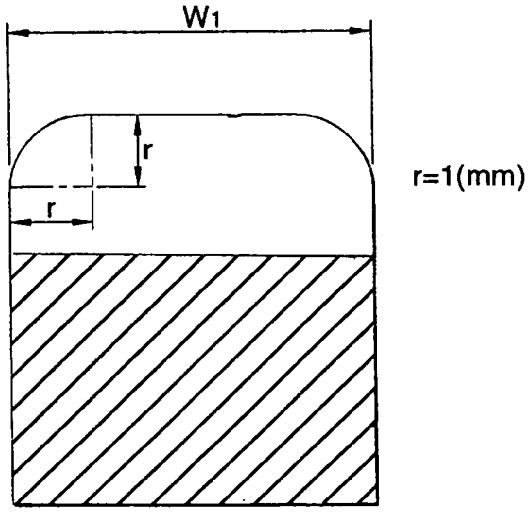
Figure 2:
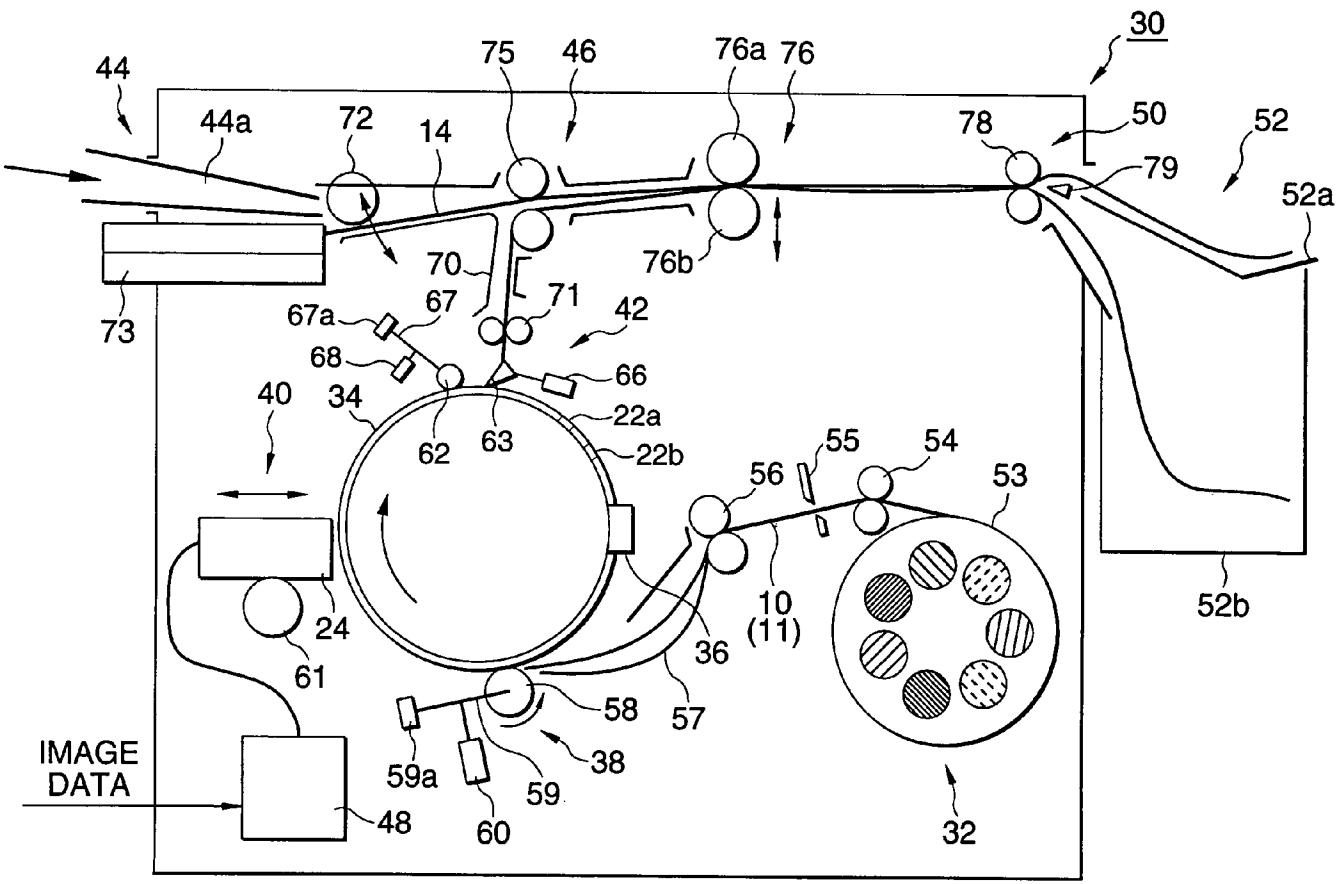
PRIOR ART FIG. 2
FIG. 2 is to show a cross sectional view showing a structure of a color image recording apparatus adopting the removing claw of the invention, FIGS. 3(*a*)–3(*b*) are to show another sectional view showing a color image recording apparatus according to an example.

Next, a recording apparatus and a removing claw according to a first embodiment of the invention will be described. FIG. 1 is a view showing a structure of a removing claw 164 according to the first embodiment of the invention. FIG. 1(*a*) is a side view showing the removing claw 164, FIG. 1(*b*) is a top view, and FIG. 1(*c*) is a sectional view showing the removing claw 164 of FIG. 1(*a*) which is taken along a line 1–1'.

Figure 7A:
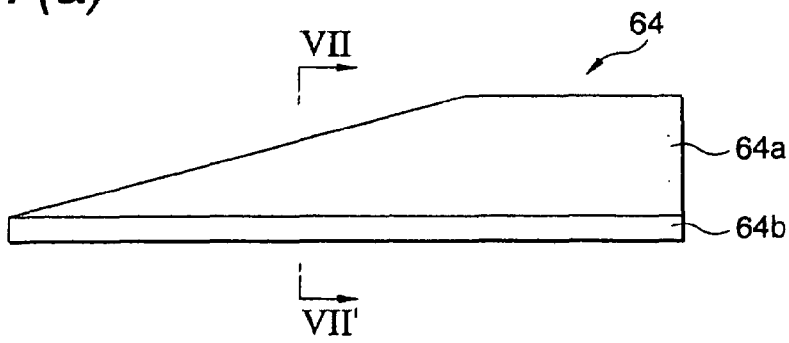
PRIOR ART FIG. 7(a)
FIGS. 7(A)–7(C) are to show a view showing a structure of a removing claw according to the conventional example.
Figure 7B:
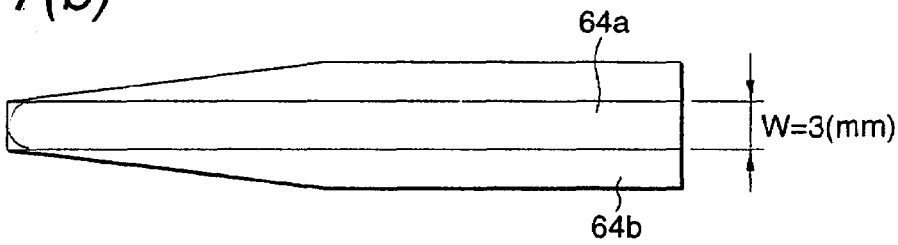
PRIOR ART FIG. 7(b)
Figure 7C:
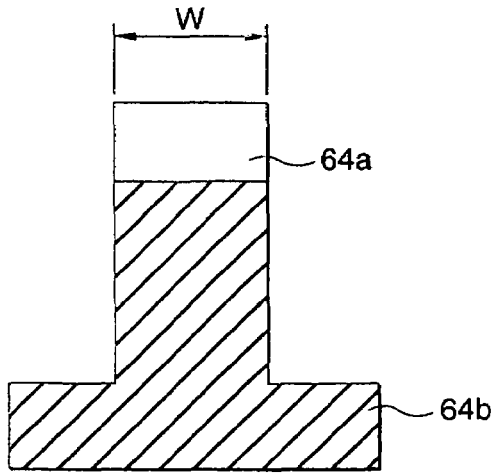
PRIOR ART FIG. 7(c)

The recording apparatus according to the embodiment comprises the removing claw 164 having a rectangular cross section with a height reduced toward a tip and having both ends of an upper side of the rectangle which are rounded or chamfered. Moreover, a width W1 in a cross direction of the removing claw 164 is greater than the width W of the removing claw 64 according to the conventional example shown in FIG. 7 and a contact area of a toner sheet 11 with the removing claw 164 is large.

Consequently, the toner sheet 11 can be delivered along the removing claw 164 without a material of the toner sheet 11 rubbed and shaved by a surface of the removing claw 164 and both ends of the upper side even if the toner sheet 11 comes in contact with the removing claw 164.

As shown in FIG. 1, the removing claw 164 according to the embodiment has a rectangle having the width W1 in the cross direction of 5 [mm] and the cross section with a height reduced toward the tip, and both ends of the upper side of the rectangle are rounded or chamfered to have a chamfered portion with a radius of curvature of r=1 [mm]. Consequently, the removing claw 164 according to the embodiment has a larger contact area with the toner sheet 11 than that of the removing claw 64 according to the conventional example. Therefore, a face pressure is reduced.

Figure 3A:
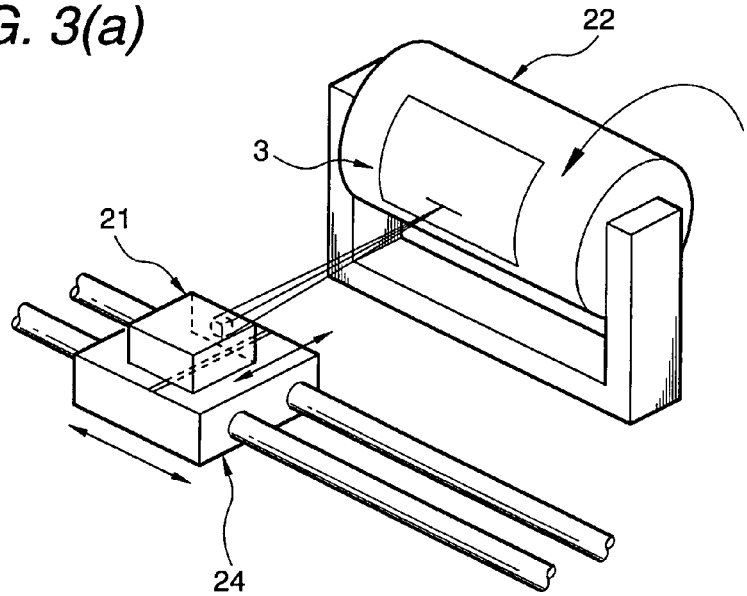
PRIOR ART FIG. 3(a)
Figure 3B:
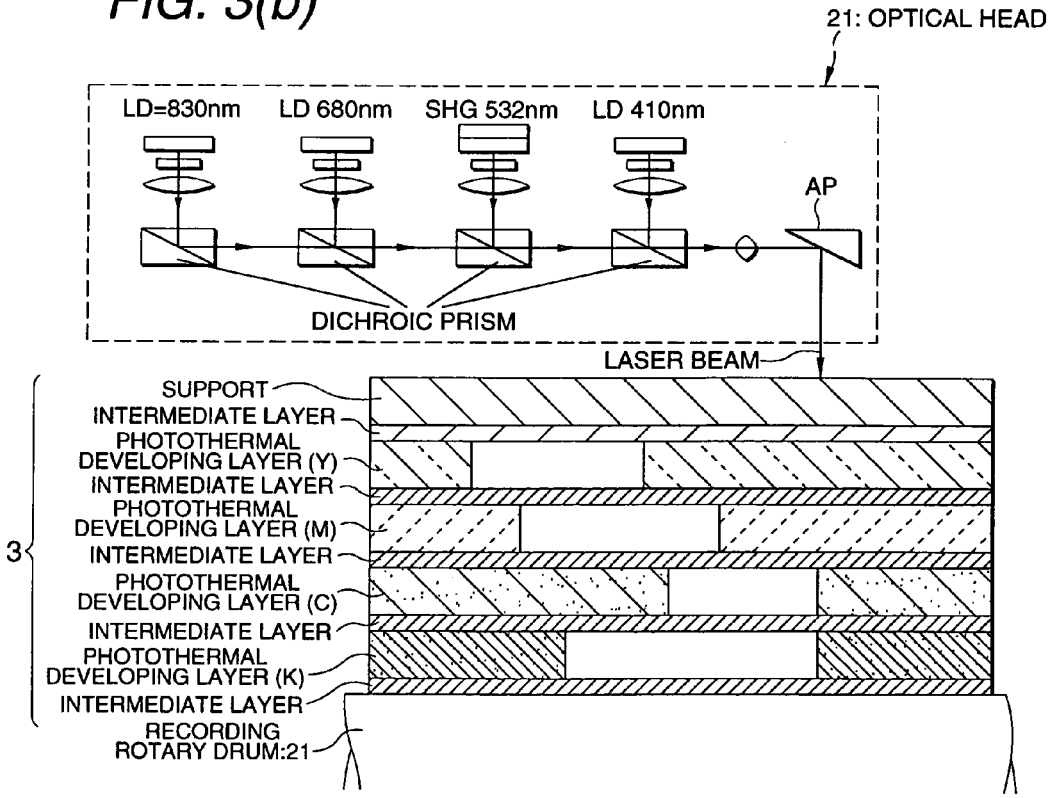
PRIOR ART FIG. 3(b)
Figure 4A:
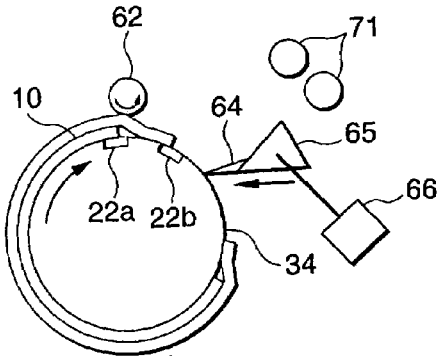
PRIOR ART FIG. 4(a)
FIGS. 4(A)–4(E) are to show the sectional views showing a removing mechanism in the color image recording apparatus of FIGS. 2 and 3, FIGS. 5(A)–5(B) are to show a view showing a structure of a removing unit in the removing mechanism of FIG. 4.
Figure 4B:
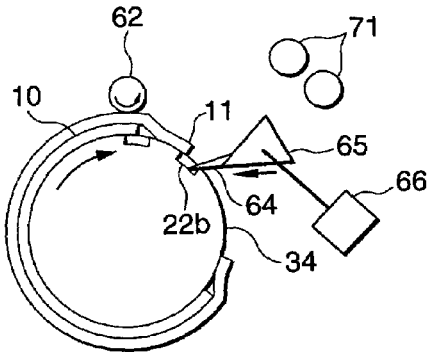
PRIOR ART FIG. 4(b)
Figure 4C:
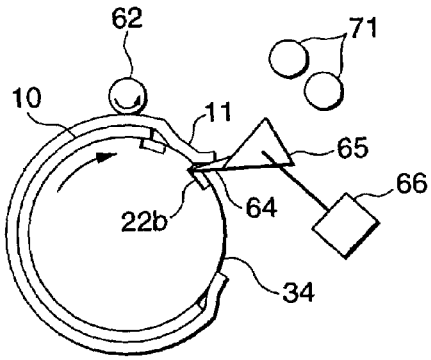
PRIOR ART FIG. 4(c)
Figure 4D:
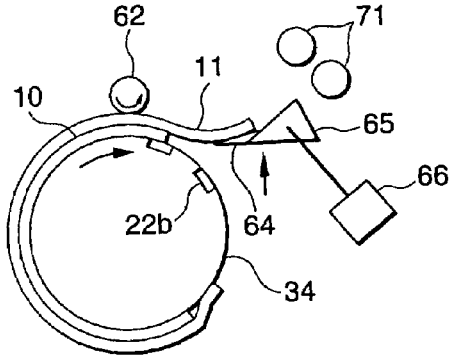
PRIOR ART FIG. 4(d)
Figure 4E:
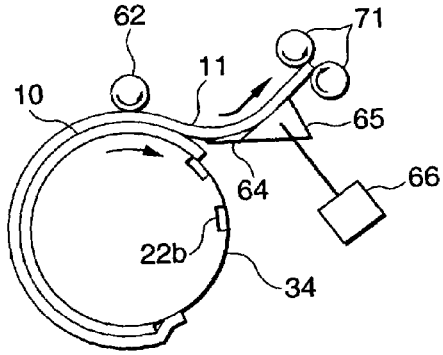
PRIOR ART FIG. 4(e)
Figure 5A:
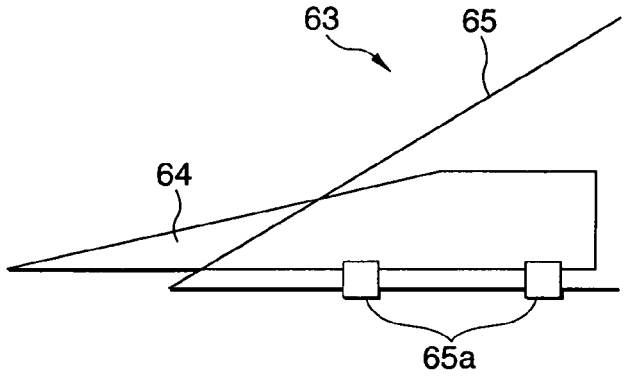
PRIOR ART FIG. 5(a)
Figure 5B:
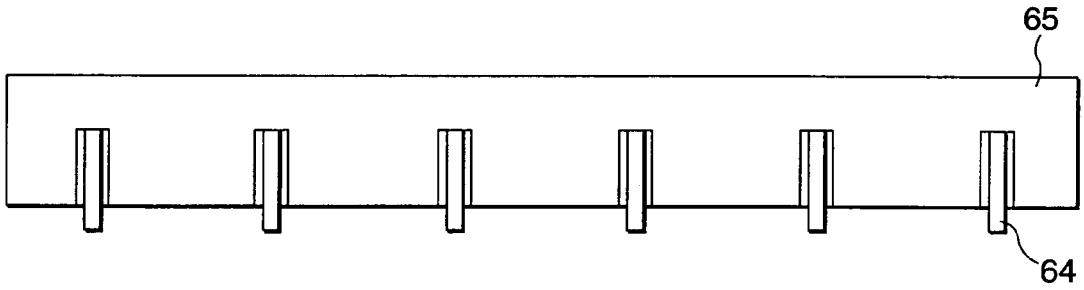
PRIOR ART FIG. 5(b)
Figure 6:
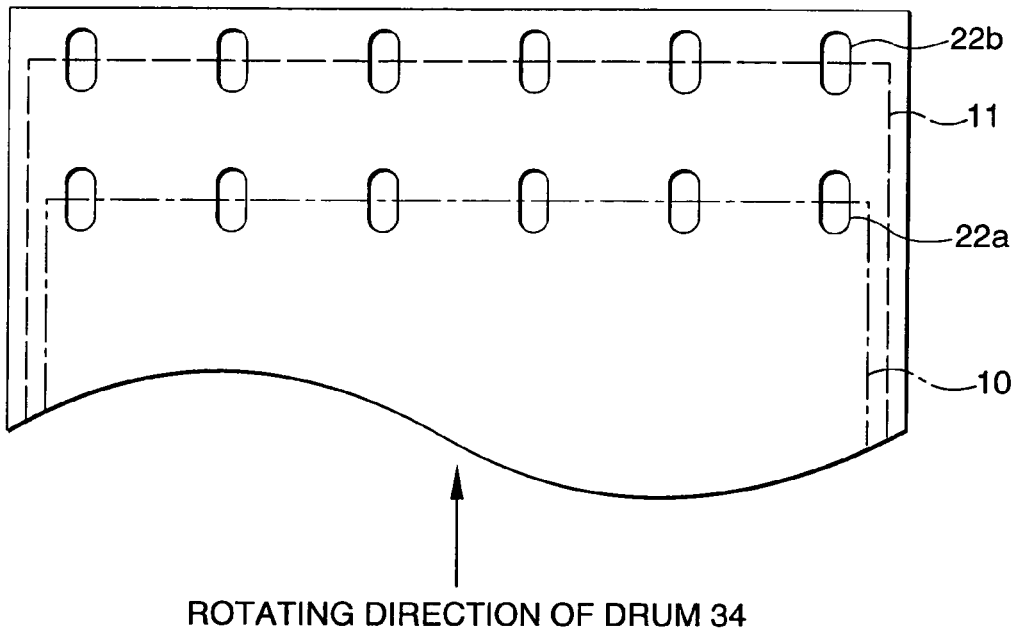
PRIOR ART FIG. 6
FIG. 6 is a partially expanded sectional view showing a recording drum.

Description will be given to the removing operation of the removing mechanism 42 in the recording apparatus comprising the removing claw 164 according to the embodiment with reference to FIGS. 3 and 4.

Since the functions and operations of components other than the removing claw 164 in the recording apparatus according to the embodiment are the same as those in the conventional example, detailed description will be omitted.

In the removing mechanism 42, when the toner sheet 11 is to be removed from a recording drum 34, a laminated product of an image receiving sheet 10 and the toner sheet 11 is first pressed from the toner sheet 11 side through a removing roller 62. Moving means 66 moves a removing unit 63 in a direction of the recording drum 34 to enter a sucking trench 22*b* for a toner sheet. Then, when a tip of the toner sheet 11 is removed and lifted by the removing claw 164 with the rotation of the recording drum 34, the toner sheet 11 is delivered to a delivery roller 71 along a metal plate guide 65 while being removed through the removing claw 164.

At this time, the removing claw 164 according to the embodiment delivers the toner sheet 11 together with the metal plate guide 65. However, since the removing claw 164 has a greater width in a cross direction than the width of the removing claw 64 according to the conventional example, a contact area of the toner sheet 11 with the removing claw 64 is large so that a face pressure of the removing claw 64 against the toner sheet 11 is reduced. Accordingly, the toner sheet 11 is neither rubbed nor shaved even if it comes in contact with the removing claw 164. Moreover, the removing claw 164 according to the embodiment has both ends of the upper side of the rectangle rounded or chamfered with a radius of curvature of r=1 [mm]. Therefore, it is possible to prevent a material of the toner sheet 11 from being shaved by a corner of the removing claw 164.

In the first embodiment, thus, the removing claw 164 has a rectangle having the width W1 in the cross direction of 5 [mm] and a cross section with a height reduced toward a tip, and both ends of the upper side of the rectangle are rounded or chamfered to have a chambered portion with a radius of curvature of r=1 [mm]. Consequently, a contact area with the toner sheet 11 is increased and the face pressure of a contact surface thereof is reduced. Accordingly, when the toner sheet 11 is to be removed and delivered in the removing mechanism 42, the toner sheet 11 can be delivered without the material thereof rubbed and shaved by the surface of the removing claw 164 and shaved by both ends of the upper side of the removing claw 164 even if the toner sheet 11 comes in contact with the removing claw 164. As a result, an image defect can be prevented from being generated on a finished image due to the shavings of the toner sheet 11 sticking onto the image receiving sheet 10 or the recording drum 34. Thus, a great image can be obtained.

While the removing claw 164 having the width W1 of 5 [mm] and the rounded or chamfered portion with a radius of curvature of r=1 [mm] has been used in the embodiment, the same effects can be obtained if a contact surface has such a width as to set a face pressure of 1 [KPa] or less and the rounded or chamfered portion has a radius of curvature of r=1 [mm] or more, which will be described below.

There will be shown a result of an experiment for the influence of a face pressure to be applied to a surface coming in contact with the toner sheet in the removing claw 164 according to the first embodiment. A toner sheet of a thin film transfer type was used.

TABLE 1

| Width W1 [mm] | Chamfer Radius [mm] | Face pressure [KPa] | Image Defect | Bad Influence to toner sheet |
|---|---|---|---|---|
| 2 | 0.5 | 3.0 | Generated | Shaved |
| 3 | 0.5 | 1.5 | Generated | Shaved |
| 3 | 1.0 | 3.0 | Generated | Shaved |
| 5 | 0.5 | 1.5 | Generated | Shaved |
| 5 | 1.0 | 1.0 | None | None |
| 8 | 1.0 | 0.5 | None | None |

As shown in the Table 1, in the case in which the face pressure was 1 [KPa] or less (a width in a cross direction was 5 [mm] or more) and both ends of the upper side of a rectangle were rounded or chamfered with a radius of curvature of r=1 [mm], the toner sheet did not generate shavings even if it comes in contact with the removing claw and the state of the finished image was also good. Accordingly, it could be confirmed that the toner sheet is not damaged by the removing claw so that the shavings of the toner sheet do not stick onto the recording drum or the image receiving sheet, resulting in no influence such as an image defect on a finished image.

As described above, the invention can provide a recording apparatus and method capable of preventing the shavings of a material from being generated when removing the material after recording, and a removing claw to be used for the apparatus.

What is claimed is:

1. A recording apparatus comprising:

removing means for removing a recording medium from the medium fixing member, said recording medium being fixed to a medium fixing member such that an active surface of the recording medium is facing to the medium fixing member, wherein the removing means has, a removing claw, the removing claw having an upper face that is operative to contact the recording medium;

side faces, the side faces respectively having a height which is reduced toward a tip such that portions joining the upper face and the side faces respectively are rounded to form rounded portions which extend along the length of the side faces; and a non-curvilinear portion provided between the rounded portions.

2. The recording apparatus according to claim 1, wherein the rounded portions have a radius of curvature of r=1 (mm) or more and the upper face has a face pressure of 1 (KPa) or less received from the recording medium being removed.

3. The recording apparatus according to claim 1, wherein the recording medium comprises a toner and an image receiving sheet, the toner sheet is of a thin film transfer type.

4. A removing claw for removing a toner sheet or an image receiving sheet from a medium fixing member, the removing claw comprising:

an upper face that is operative to contact the recording medium;

side faces, the side faces respectively having a height that is reduced toward a tip such that portions joining the upper face and the side faces respectively are rounded to form rounded portions which extend along the length of the side faces; and a non-curvilinear portion provided between the rounded portions.

5. The removing claw according to claim 4, wherein the rounded portions have a radius of curvature of r=1 (mm) or more and the upper face has a face pressure of 1 (KPa) or less received from the recording medium being removed.

6. The removing claw according to claim 4 or 5, wherein the toner sheet is of a thin film transfer type.

7. A recording method utilizing a recording apparatus having a removing claw comprising:

fixing the image receiving sheet onto the medium fixing member, said image receiving sheet having an image receiving layer to receive an image of a recorded image;

fixing the toner sheet onto the image receiving sheet; and removing the toner sheet or the image receiving sheet from the medium fixing member using a removing claw, the removing claw having, an upper face that is operative to contact the recording medium;

side faces, the side faces respectively having a height which is reduced toward a tip such that portions joining the upper face and the side faces respectively are rounded to form rounded portions which extend along the length of the side faces; and a non-curvilinear portion provided between the rounded portions, such that the toner sheet or the image receiving sheet applies a pressure to an the upper face of the removing claw including the rounded portions upon removal.

* * * * *